US007029113B2

(12) United States Patent
Hwang

(10) Patent No.: US 7,029,113 B2
(45) Date of Patent: Apr. 18, 2006

(54) TRAY-ACCESS DOOR DEVICE AND METHOD

(75) Inventor: Peter G Hwang, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/247,887

(22) Filed: Sep. 20, 2002

(65) Prior Publication Data

US 2004/0056941 A1 Mar. 25, 2004

(51) Int. Cl.
*B41J 29/13* (2006.01)

(52) U.S. Cl. ..... 347/108; 347/138; 347/170

(58) Field of Classification Search ..... 347/108, 347/109, 2, 3, 138, 170, 222; D18/4, 50, D18/15; 40/515, 591, 765; 400/691
See application file for complete search history.

(56) References Cited

U.S. PATENT DOCUMENTS

| | | | | |
|---|---|---|---|---|
| 4,817,842 | A | 4/1989 | Wilson, III | |
| 4,926,196 | A | 5/1990 | Mizoguchi et al. | |
| D321,898 | S * | 11/1991 | Kasee et al. | D18/55 |
| 5,281,018 | A | 1/1994 | Cullinan | |
| 5,523,848 | A * | 6/1996 | Musso et al. | 358/296 |
| 5,567,068 | A * | 10/1996 | Egashira et al. | 400/625 |
| 5,592,361 | A * | 1/1997 | Smith et al. | 361/679 |
| 5,657,132 | A * | 8/1997 | Samii | 358/296 |
| 5,796,575 | A | 8/1998 | Podwalny et al. | |
| 6,067,738 | A * | 5/2000 | Zeligson | 40/606.02 |
| D438,895 | S * | 3/2001 | Pangburn | D18/55 |
| 6,367,996 | B1 | 4/2002 | Edwards | |
| D468,765 | S * | 1/2003 | Kobayashi et al. | D18/55 |
| 6,557,992 | B1 * | 5/2003 | Dwyer et al. | 347/108 |
| D479,264 | S * | 9/2003 | Suzuki et al. | D18/55 |
| D480,752 | S * | 10/2003 | Tatara et al. | D18/55 |
| 6,676,318 | B1 * | 1/2004 | Hwang et al. | 400/693 |
| 6,848,685 | B1 * | 2/2005 | Katsuyama | 271/162 |
| 6,899,422 | B1 * | 5/2005 | Strowe et al. | 347/108 |
| 2003/0052956 | A1 * | 3/2003 | Katsuyama | 347/108 |

FOREIGN PATENT DOCUMENTS

JP 06106801 A * 4/1994

OTHER PUBLICATIONS

Sony New Releases, http://www.sony-asia.com.sg/news/sepOOcnews4.html, "Sony Offers New Ways of Enjoying Digital Still Cameras With the New 'Cyber-shot'", Sep. 12, 2000.

Sony Website, http://www.sony,co.jp/sd/products/Consumer/popegg/printer.html, "PrintFan with Popegg".

EPSON America, Inc.—Product Information—EPSON Stylus C60, http:/www.epson.com/cgi-bin/Store/ProductQuickSpec_BigImage.jsp, Apr. 17, 2002.

* cited by examiner

*Primary Examiner*—Manish S. Shah
*Assistant Examiner*—Leonard Liang

(57) ABSTRACT

A tray-access door device is provided that includes a body having first and second ends. Preferably, an access door is connected at or about the first end of the body and a tray is connected at or about the second end of the body. In an operational configuration, the tray at least partially covers an access opening formed between the access door and the tray. In a closed configuration, the tray at least partially covers the access opening, and the access door at least partially covers the tray.

28 Claims, 6 Drawing Sheets

FIG 4
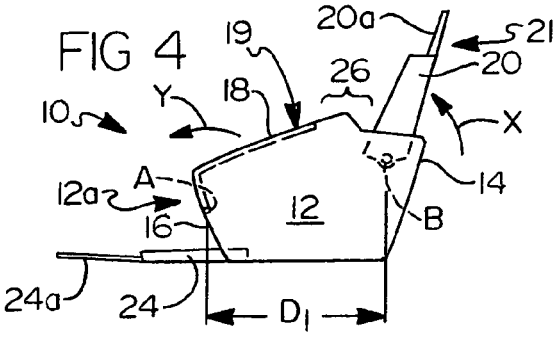
FIG 1
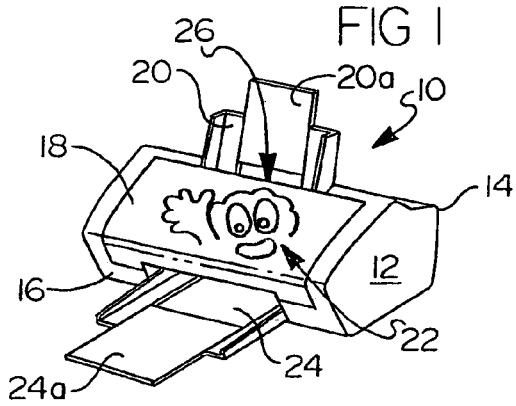
FIG 5
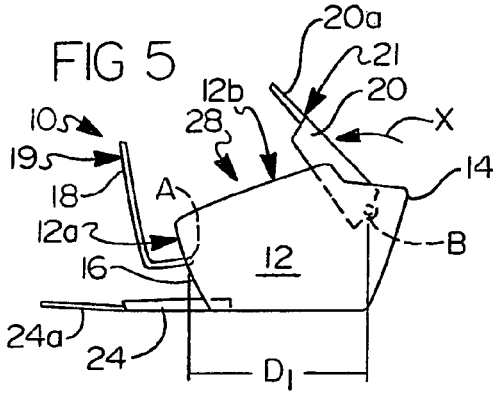
FIG 2
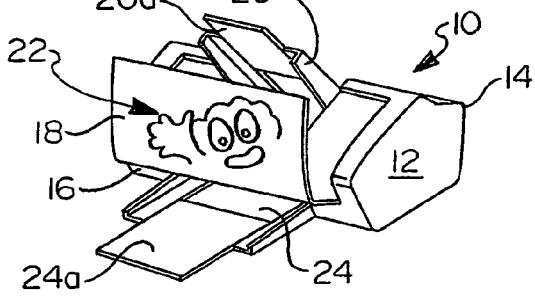
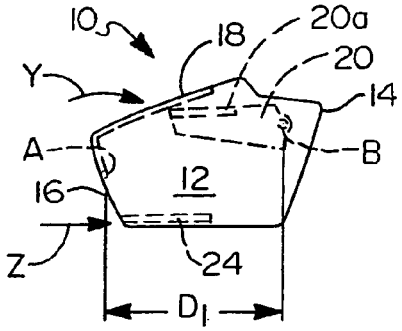
FIG 6
FIG 3
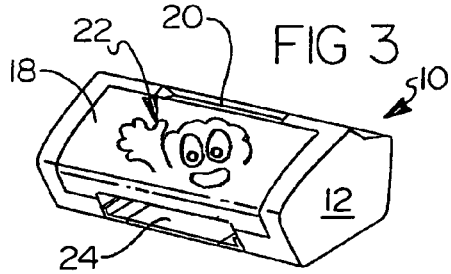

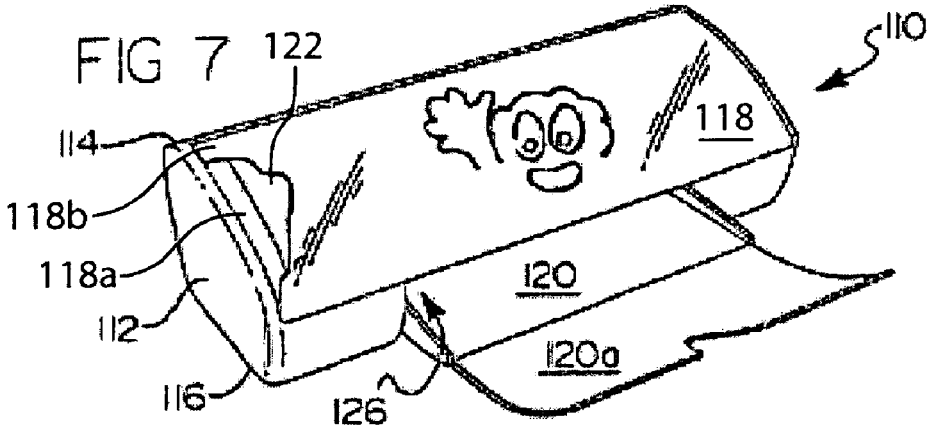
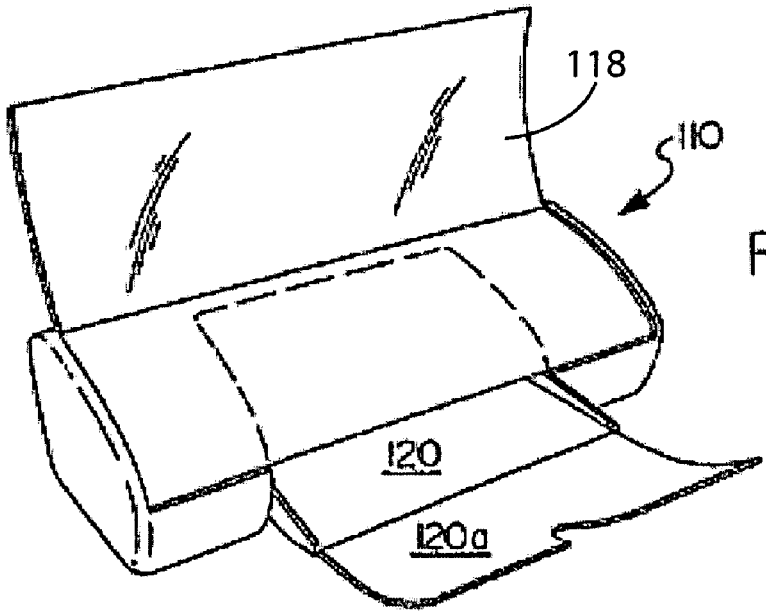
FIG 8
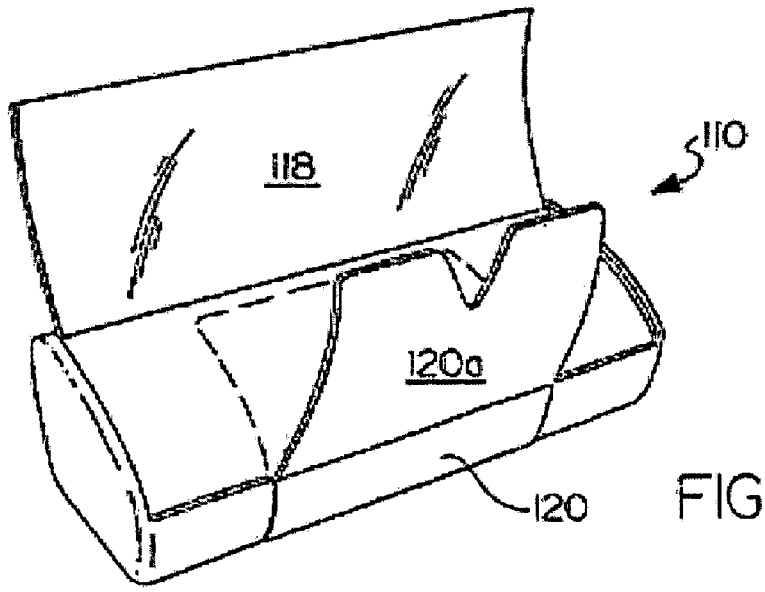
FIG 9

FIG 10
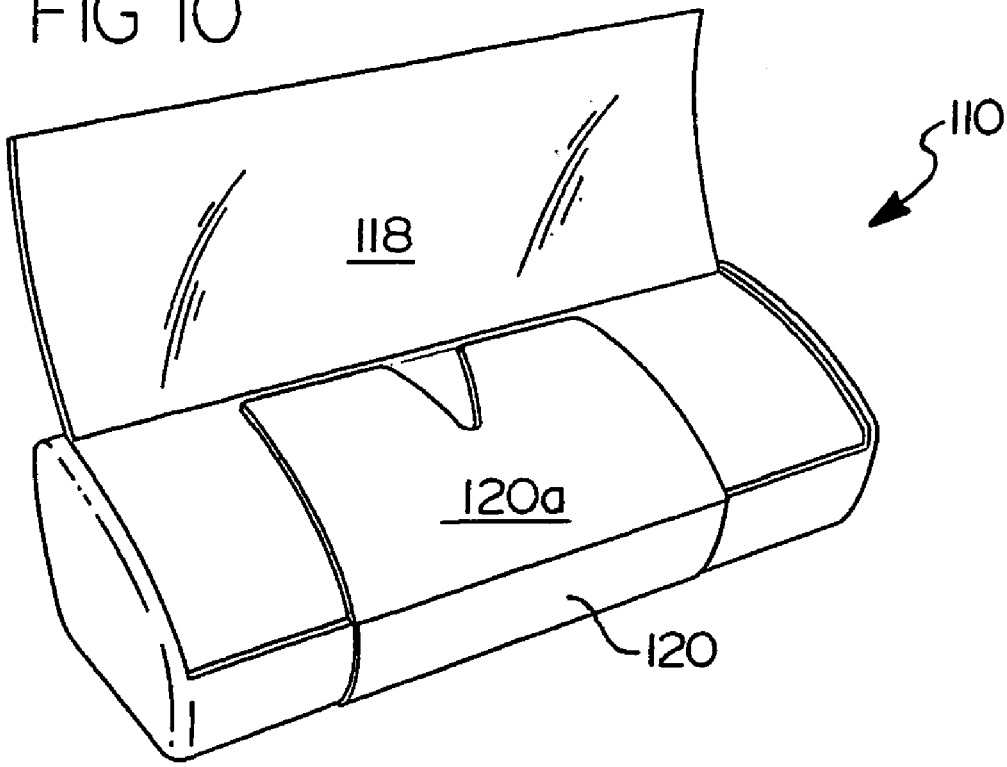
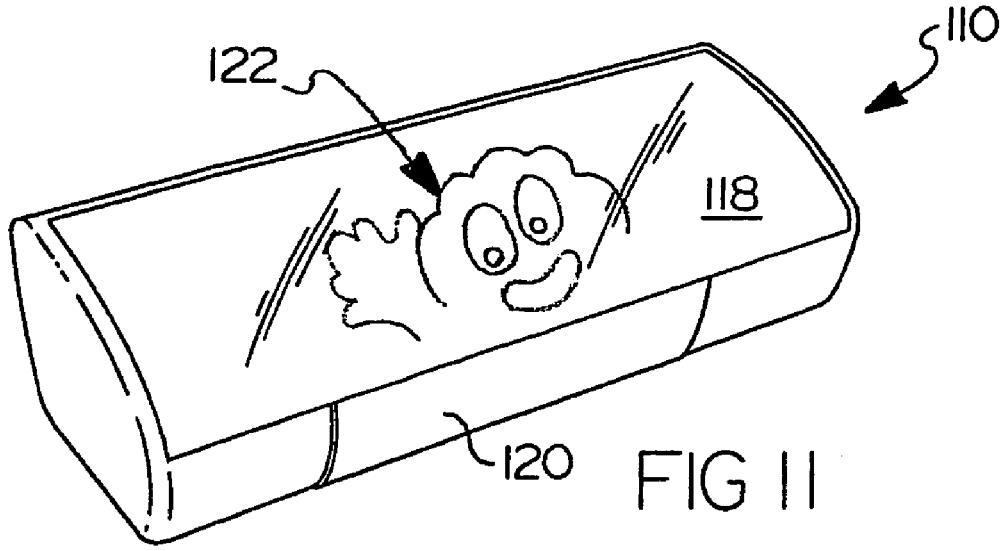
FIG 11

TRAY-ACCESS DOOR DEVICE AND METHOD

BACKGROUND OF THE INVENTION

Conventional peripheral devices, such as desktop printers, often include extendable or retractable trays (e.g., paper trays). Such devices also commonly include transparent, opaque, or tinted access doors. However, among other things, there is a desire to provide a device in which the associated tray (or trays) may be selectively configured. Further, for some applications, there is a desire to provide an access door that may be modified, customized or reconfigured by the user for viewing media selected by a user.

SUMMARY OF THE INVENTION

An embodiment of the invention is directed to a tray-access door device. The device includes a body having a first end and a second end. An access door is connected at or about the first end and a tray is connected at or about the second end., In an operational configuration, the tray at least partially covers an access opening formed between the access door and the tray. In a closed configuration, the tray at least partially covers the access opening, and the access door at least partially covers the tray.

Further aspects of embodiments of the invention will be apparent after reviewing the detailed description below and the corresponding drawings.

BRIEF DESCRIPTION OF THE DRAWINGS

FIG. 1 is a perspective view illustration of a device including a tray and access door according to an embodiment of the invention and showing the access door in a closed configuration and the tray in an extended and operational configuration.

FIG. 2 is a perspective view illustration of the device shown in FIG. 1, wherein both the access door and the tray are shown in an intermediate extended configuration.

FIG. 3 is a perspective view illustration of the device shown in FIG. 1, wherein the access door and tray are both shown in a closed configuration.

FIG. 4 is a side view illustration of an embodiment of a device showing a tray in an extended configuration and an access door in a closed configuration.

FIG. 5 is a side view illustration of the device of FIG. 4 showing a tray in an intermediate extended configuration and an access door in an extended configuration.

FIG. 6 is a side view illustration of the device of FIG. 4 showing a tray and access door in a closed configuration FIG. 7 is a perspective view illustration of a device according to an embodiment of the invention that shows an access door in a closed configuration and a tray in an extended operational configuration.

FIG. 8 is a perspective view illustration of the device shown in FIG. 7, wherein both the access door and the tray are shown in extended configurations.

FIG. 9 is a perspective view illustration of the device shown in FIG. 8, wherein the access door is shown in an extended configuration and the tray is shown in an intermediate extended position.

FIG. 10 is a perspective view illustration of the device shown in FIG. 9, wherein the tray is shown in a closed configuration.

FIG. 11 is a perspective view illustration of the device shown in FIG. 10, wherein the access door and tray are both shown in a closed configuration.

DETAILED DESCRIPTION OF THE EMBODIMENTS

Figure 12:
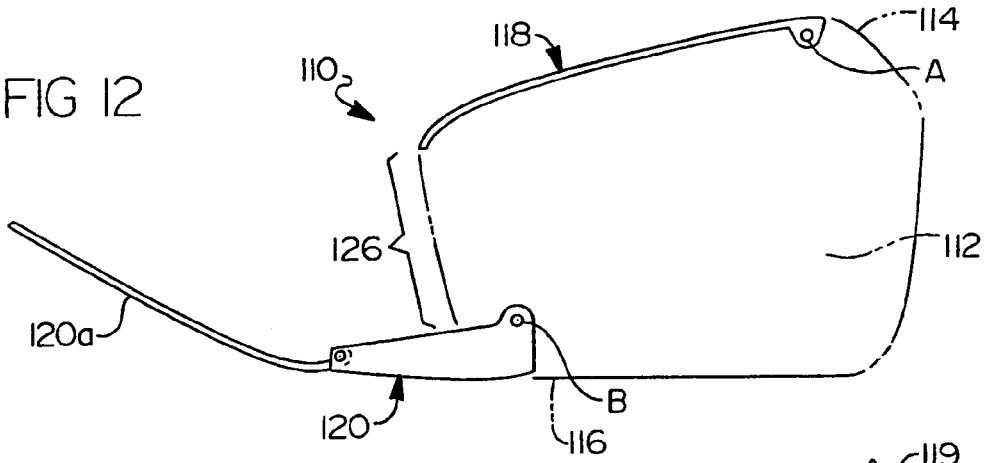
FIG. 12 is a side view illustration of an embodiment of a device showing a tray in an extended configuration and an access door in a closed configuration.

FIG. 1 illustrates a perspective view of a device 10 according to an embodiment of the invention. Although, the illustrated device 10 takes the form of a printer, the invention is not limited to being used in connection with a specific device and may be used with various types of printers and other devices. Such devices may include, without limitation, fax machines, copiers, scanners, and various multi-function devices.

The device 10 includes a body 12, including a first end 14 and a second end 16; an access door 18; and a tray 20. The first and second ends 14, 16 are spaced apart from one another and may be included as part of separate components that are connected (or are otherwise assembled) to form the body. However, in a preferred embodiment, the body 12 is comprised of plastic or polymer and is molded or formed as an integral unit that includes both first and second ends 14 and 16.

The access door 18 preferably includes decorative ornamentation that may be externally visible to the user both in operational and closed configurations. Such decorative ornamentation may include, without limitation, decorative surface ornamentation (such as physical or ornamental features associated with the door 18 itself) or a decorative sheet or other decorative media 22 that is visible through at least a portion of the door 18. Preferably such decorative ornamentation may be reconfigured by the user. In a preferred embodiment the access door 18 is configured to retain a decorative media 22 and is at least partially comprised of a transparent or translucent material (e.g., plastic). Further, the access door 18 may, for example, include inner and outer panel portions, a slot/passage configuration, and/or or other attachment means (e.g., clips, pads) that are suitable for retaining a decorative media for external viewing on or through the door. In alternative embodiments, the access door may have permanent ornamentation and all or portions of the access door 18 may be replaced as desired by a user to provide different appearances.

Figure 15:
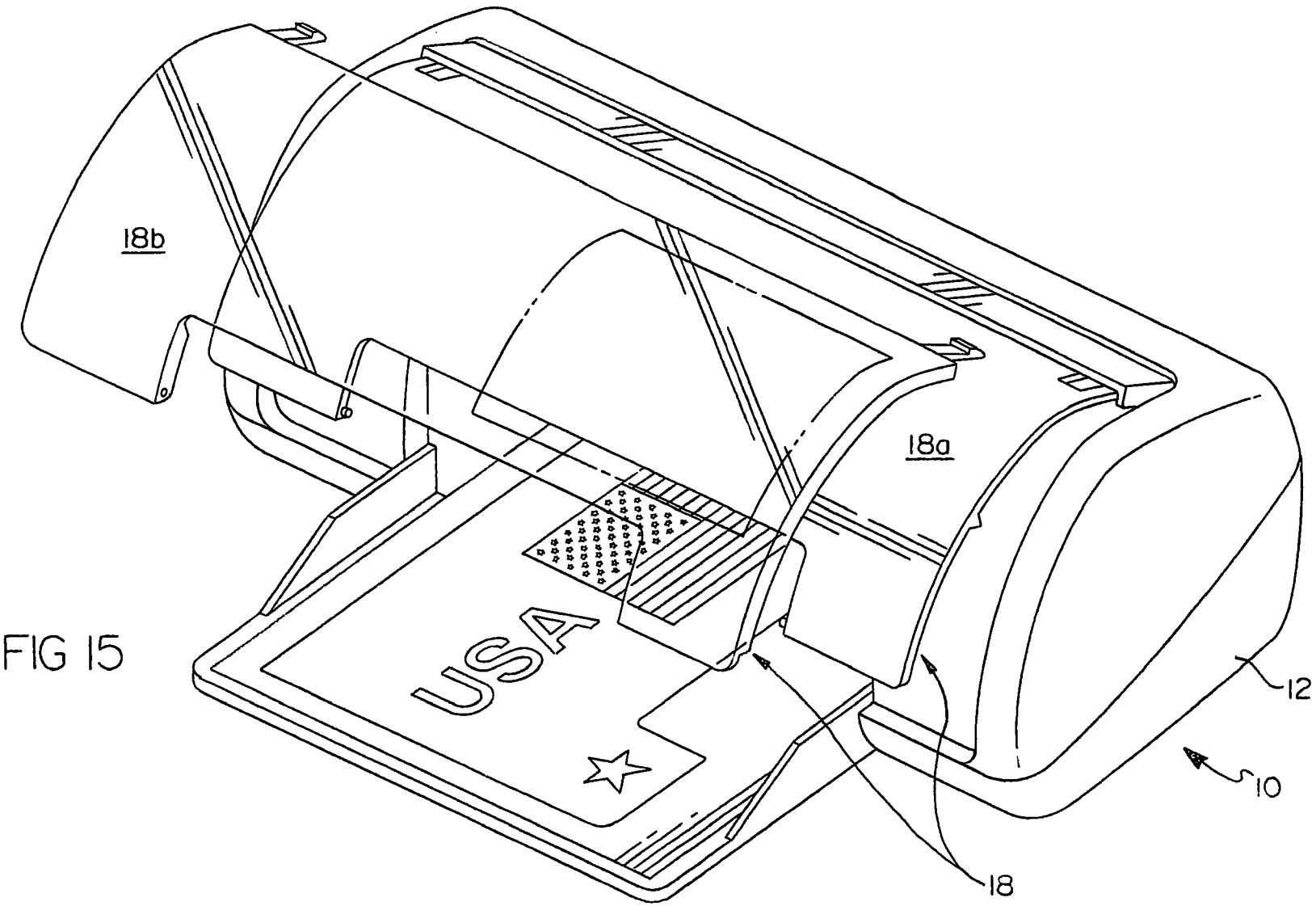
FIG. 15 is a perspective view showing an example of a device with an access door comprised of inner and outer panel portions.
Figure 16:
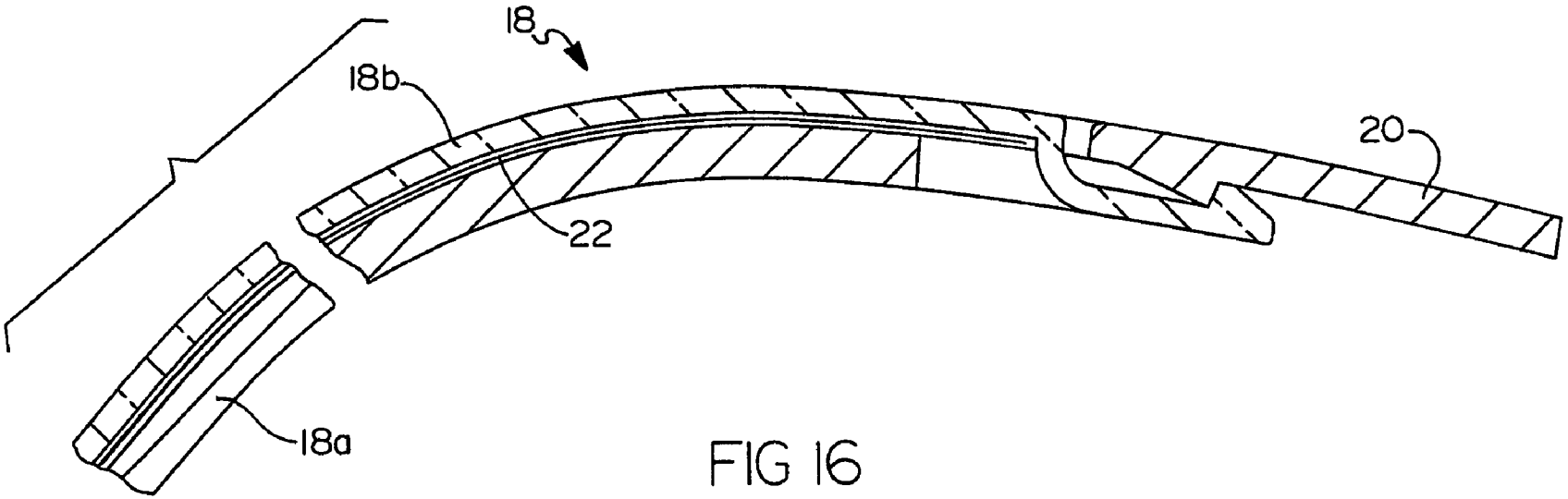
FIG. 16 is a side view of an access door that includes a decorative media positioned between an inner and an outer panel portion.

If the access door 18 is comprised of "inner" and "outer" panel portions (as viewed externally by a user), the panels may be connected at least at one end and, more preferably, will be connected (e.g., at a common end) to permit at least partial separation of the panels without disassembly from the device 10. By way of example, without limitation, a two-panel access door 18 may be pivotally connected about an axis at a common connection point. An example of an "inner-and-outer panel" access door 18 is generally shown in FIGS. 15 and 16. As illustrated, access door 18 includes inner and outer access panels 18*a* and 18*b*, respectively. Preferably, the outer panel 18*b* includes a transparent or translucent portion. The panels 18*a*, 18*b* may be pivotally or rotationally connected to one another and/or to the body 10, for example, using pivotal or pin-hole configurations. Also, in a preferred embodiment, the panels 18*a*, 18*b* may be pivotally separated, and a decorative media 22 (such as a decorative sheet) may be positioned therebetween.

In a preferred embodiment, such as illustrated in FIG. 1, first end 14 is located toward the "rear" of the body 12 and second end 16 is located toward the "front" of the body 12. In this context, the terms "front" and "rear" are merely intended to help generally define a separation of first and second ends or portions of a body relative to one another, and are not intended to require a precise or specific position and/or orientation. An access door 18 is connected at or about the first end 14. Likewise, a tray 20 (such as a top-in paper tray) is connected at or about the second end 16. The tray 20 may optionally include a tray extension 20*a* that is connected to the tray 20 and may be extended in and out from the tray 20. In a preferred embodiment the tray extension 20*a* may be slidably extended and retracted. As used herein, the terminology "at or about" is intended to mean that the associated element may be connected at the specified point, position, or region, or may instead be connected near or in the general proximity of the noted point, position, or region.

The device 10 may optionally include a second tray 24 (such as an output tray), which may be used to receive output. The second tray 24, if included, may be formed of one or more pieces and is preferably substantially retractable and extendable in and out of body 12. An example of a retractable and extendable tray 24 is shown in FIGS. 1–6.

Preferably, portions of the access door 18 and tray 20 (e.g., positions at or near edges) are connected to the body 12, such as by a pin-hole (and/or pivot-joint connection), snap-hook, or other conventional pivotal connection configurations. For example, without limitation, the access door 18 and/or tray 20 may include external protrusions (e.g., bumps, extensions, flanges, pins, etc.) that are received by corresponding openings or attachments on the body 12 to secure the door 18 and/or tray 20 to the body 12 and/or to improve the handling of the door 18. Moreover, such components may be configured vice versa in a reverse orientation wherein the body 12 includes the protrusions and the access door and/or tray include corresponding openings or attachments. It is important to note, however, that the invention is not limited to a specific type of connector or manner for connecting the access door 18 and/or tray 20 to the body 12. As such, various other means for connecting the door 18 and tray 20 can also be employed.

In a preferred embodiment, the connection between the access door 18 and/or tray 20 to the body 12 permits the door 18 and tray 20 to pivot (or rotate) about an axis through a connection point associated with the body, such as connection points A and B, respectively, shown in FIGS. 4 through 6. The access door 18 and tray 20 are configured so that their "unsecured" ends (i.e., the ends opposite the ends connected to the body as discussed above, such as those identified as 19 and 21 in FIGS. 4 and 5) may pivot, rotate, or flip towards each other. Preferably, the distance $D_1$ between the connection points of the access door 18 and the connection points of the tray 20 (e.g., as shown in FIGS. 4–6) is such that when the tray 20 is in its closed and retracted position (in the direction of the door 18), the unsecured end 21 of the tray 20 does not reach or extend outwardly beyond the connection point (e.g., point A) of the door 18 or otherwise interfere with the pivoting of the door 18 from an open/extended configuration to a closed configuration. For example as shown in FIG. 6, it is preferred that the access door 18 and tray 20 may be pivoted so that a portion of the outer or externally visible surface of the access door 18 "overlaps" or covers a significant portion of the tray 20.

For some embodiments, such as shown in FIGS. 3 and 6, the access door 18 substantially covers the tray 20 when the device 10 is in a "buttoned up" or "closed" configuration, i.e., a configuration in which the access door 18, tray 20, and extensions thereof (if any) are in a retracted position. Notably, with the access door 18 in such a closed configuration, the ornamentation associated with the access door 18, such as a decorative media 22 (which the user may configure), is as externally visible when the device 10 is in the closed configuration as the ornamentation is in the FIG. 1 example of an "operational" configuration.

As illustrated in the embodiment shown in FIGS. 1–6, the access door 18 may be pivotally connected or hinged to the lower front region 12*a* of the body 12. However, other embodiments of the device 10 may have the door 18 connected at higher (or lower) positions upon the front and/or top of the body 12. Preferably, the access door 18 is designed to sufficiently pivot or otherwise rotate about an axis through a connection point, such as the point labeled A in FIGS. 4–6. The access door 18 covers a component access opening 28 and when opened provides access to the inner components of the associated device, as for example for changing ink, pens, and ink cartridges. In the illustrated embodiment, to obtain access to the inner components of the device 10, a user need only pivot the access door 18 away from the access opening 26. For certain applications, the access door 18 may be sufficiently large so that it substantially covers the front and top faces (e.g., 12*a* and 12*b*, respectively, such as identified in FIG. 5) of the device 10. By changing the decorative media 22 associated with the access door 18 or changing all or portions of the door 18 itself, a user may significantly change the appearance and "personality" of the associated device 10. Moreover, if desired, tabs or other handling formations (not shown) may be connected to or included with the access door 18 to facilitate movement and manipulation by the user.

Also as illustrated in the embodiment shown in FIGS. 1–6, the tray 20 may be pivotally connected or hinged to the body 12, as for example toward the first end 14. Other embodiments of the device 10 may have the tray 20 connected at other positions towards the rear and/or top of the body 12. Preferably, the tray 20 is designed to sufficiently pivot or otherwise rotate about an axis through a connection point, such as the point labeled B in FIGS. 4–6. If desired, tabs, finger-latches, or other formations (not shown) may be connected to or included with the access door 18 and/or tray 20 to facilitate movement and manipulation by the user.

Referring again to FIG. 1, a perspective view of a device 10 according to an embodiment of the invention is shown. The figure depicts an access door 18 (including a decorative media 22) in a "closed" configuration. An associated tray 20 is shown in an extended configuration. In this "operational" or functional configuration, as perhaps better shown in FIG. 4, an access space or access opening 26 is formed between the access door 18 and tray 20. Arrows X and Y shown in FIGS. 4 and 5 generally depict the pivotal motion associated with the tray 20 and access door 18, respectively. The access opening 26 may accommodate functional aspects of the device 10. For instance, an example of a functional aspect is shown in the illustrated embodiment, in which the paper feed access opening 26 is shaped and sized to permit paper to feed through from atop of tray 20 to inner components of the associated device 10.

FIGS. 2 and 5 show an access door 18 and a tray 20 positioned in intermediate extended/open positions. The arrow X shown associated with the tray 20 in FIG. 5 shows the general direction that the tray may pivot (such as about an axis through connection point B) towards the access door. In the illustrated embodiment, the access door 18 is first moved to an extended/open position to create an open or clearing space (generally identified in FIG. 5 as 28) so that the tray 20 has sufficient clearance to enter the body 12 of the device 10. It is also noteworthy that when the access door 18 and tray 20 are both in an extended configuration, the opening formed between the tray 20 and the access door 18 is fairly extensive and may provide a user with significant access to the inner components of the device 10.

Examples of a generally "closed" or "buttoned up" configuration of the device 10 are shown in FIGS. 3 and 6. FIG. 6 shows a second tray 24 that has been moved (in the direction of the associated arrow Z) into or inside the body 12 from an extended position. If desired, for example as shown in FIGS. 2 and 5, the second tray 24 may optionally include an extendable and retractable extension 24*a* that is connected to the tray 24. Preferably, the extension 24*a* is slidably connected to the tray and may be retracted with the second tray 24. FIG. 3 shows an example of a second tray 24 in a retracted position within body 12. As illustrated, both the tray 20 and access door 18 may be flipped or pivoted (about an axis through connection points A and B) towards one another and back towards the open portion of the body 12.

As shown in FIGS. 3 and 6, and by way of example, tray 20 is positioned or stowed away inside the body 12 above or on top of the internal components of the device 10; and the access door 18 is adjacent to and "overlaps" or covers at least a portion of the tray 20. More preferably, the access door 18 covers a significant portion of the tray 20 and portions of the door 18 and tray 20 are designed to dovetail, custom "fit," or otherwise interconnect with one another. For some applications, the interconnection or relative positioning between the door 18 and tray 20 create a substantially "flush" (flush and/or generally smooth to the touch) exterior surface interconnection.

Significantly, the embodiments shown permit the associated ornamental aspects of the access door 18 to be externally viewed in both operational (FIG. 1) and closed (FIG. 3) configurations. Moreover, for certain applications, the access door 18 may be closed to provide a generally "clean" or smooth external appearance with respect the tray 20.

FIG. 7 illustrates a perspective view of another embodiment of a tray-access door device 110. The device 110 includes a body 112, including a first end 114 and a second end 116; an access door 118; and a tray 120. The first and second ends 114, 116 are spaced apart from one another and, if desired, may be included with separate components that are connected (or are otherwise assembled) to form the body. However, preferably, the body 112 is comprised of plastic or polymer and is molded or formed as an integral unit that includes ends 114 and 116.

Figure 13:
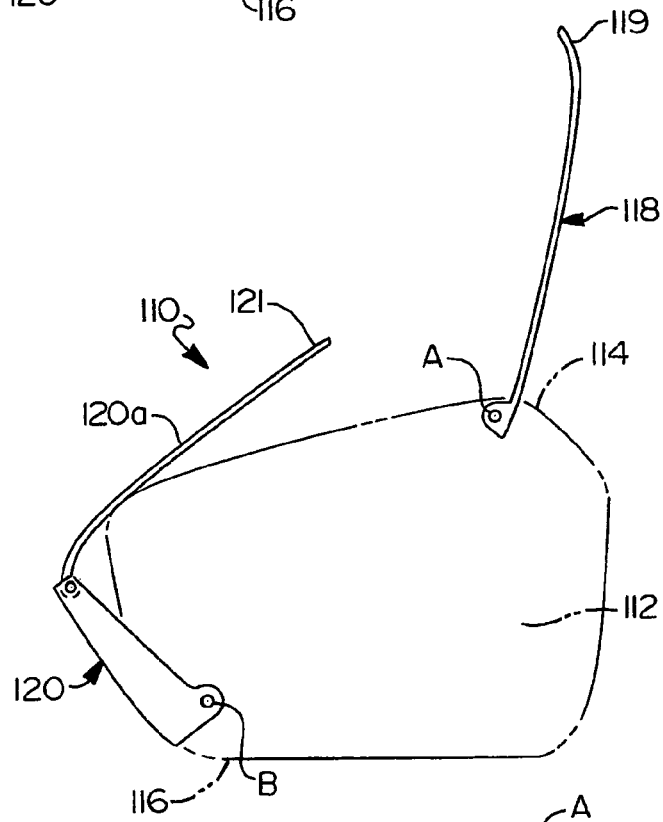
FIG. 13 is a side view illustration of the device of FIG. 12 showing a tray in an intermediate extended configuration and an access door in an open configuration.
Figure 14:
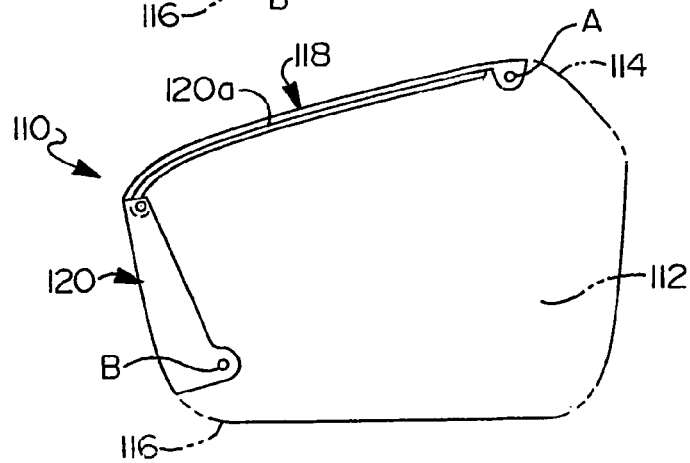
FIG. 14 is a side view illustration of the device of FIG. 12 showing a tray and an access door in a closed configuration

FIGS. 7–11 illustrate some of the possible configurations of the device 110 between an operational configuration (such as FIG. 7, where the tray 120 is extended and the access door 118 is closed) and a buttoned-up or closed configuration (such as FIG. 11, where the tray 120 and the access door 118 are retracted and closed). FIG. 8 depicts the device 110 in an expansive configuration wherein the access door 118 and/or the tray 120 are pivoted open or extended and a user has a significant amount of access to the inner operational components of the device 110. FIGS. 9 and 10 show how the tray 120 may first be closed or retracted into or onto the body 112. FIG. 11 shows how the access panel 118 may then be positioned to cover a significant portion of an outer surface of the tray 120 (which in the figure includes both elements 120 and 120*a*) when the components are in a closed or buttoned-up configuration. In this manner, a decorative media 122 or other ornamentation associated with the access door 118 (e.g., ornamentation associated with the outer surface of the door 118) may be substantially externally visible in both the operational and buttoned-up/closed configurations. FIGS. 12, 13 and 14 illustrate how an optional extension 120*a* may also be stored in a device 110 in connection with a tray 120.

Like the previously discussed embodiment, the access door 118 may include decorative ornamentation. Preferably, the door 118 is configured to retain a decorative sheet or other decorative media 122 that is visible through at least a portion of the access door 118 and may be reconfigured by the user. The access door 118 may be at least partially comprised of a transparent or translucent material (e.g., plastic) and may include split inner and outer panel portions 118*a* and 118*b*, respectively (shown in FIG. 7). Alternatively, door 118 may include a slot/passage configuration, and/or other attachment means (e.g., clips, pads) that are suitable for retaining a decorative media for external viewing on or through the door 118. In alternative embodiments, the access door 118 may have permanent ornamentation and the entire door 118 may be replaced as desired by a user to provide different appearances.

In the embodiment illustrated in FIG. 7, first end 114 is located toward the "top" portion of the body 112 and second end 116 is located toward the "bottom" portion of the body 112. Access door 118 is connected to the body 112, preferably at or in general proximity to the first end 114. Likewise, tray 120 is connected to the body 112, preferably at or in general proximity to the second end 116. In the representative embodiment, the access door 118 is shown connected toward the rear of the device 110 and the tray 120 is shown connected toward the front (i.e., the end opposite the rear) of the device 110.

In the illustrated embodiment, such as shown in FIGS. 12–14, access door 118 is connected at or about the first end 114 at an axis through a connection point that is designated in the representative embodiment as point A. Tray 120 is connected at or about the second end 116 at an axis through a connection point that is designated in the representative embodiment as point B. Portions of the access door 118 and tray 120 (e.g., positions at or near edges) are connected to the body 112, such as by a pin-hole, pivot-joint, snap-hook, or other conventional pivotal connection configurations. It is important to again note that the invention is not limited to a specific type of connector or manner for connecting the access door 118 and/or tray 120 to the body 112, including those previously described. Various means for providing the functional connection may also be employed without departing from the teachings of the invention.

As generally shown in FIGS. 12–14, the connection between the access door 118 and/or tray 120 to the body 112 preferably permits each of the door 118 and tray 120 to pivot or rotate about an axis through a connection point associated with the body (such as an axis associated with connection points A and/or B). The access door 118 and tray 120 are configured so that their "unsecured" ends (i.e., the ends opposite the ends connected to the body as discussed above, such as those identified as 119 and 121 in FIG. 13) may pivot or rotate towards one another. Moreover, the access door 118 and tray 120 may be rotated or pivoted, for example as shown in FIG. 14, so that at least a portion of the access door 118 "overlaps" the surface of the tray 120, and more preferably overlaps a significant portion of the surface of tray 120 and/or extension 120*a*.

In an open or operational configuration, such as shown in FIGS. 7, 8, and 12, the tray 120 is pivoted outward or extended forward from the body 112 and an access opening 126 is formed between the access door 118 and the tray 120.

In a closed configuration, the tray 120 is positioned toward or against the body 112 to at least partially (and more preferably, substantially) cover the access opening 126. In a preferred embodiment, the access door 118 may also include a decorative media that may be selectively included and/or reconfigured by a user.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

The invention claimed is:

1. A tray-access door device, comprising:

a body including a first end and a second end;

an access door connected at or about the first end, the access door having a first face and a first edge;

a first tray connected at or about the second end, the first tray having a second face and a second edge, wherein the first tray includes a first portion pivotally coupled to the body and configured to extend along and overlap a side of the body and a second portion pivotally coupled to the first portion and configured to extend along and overlap a top of the body;

wherein the first tray at least partially covers an access opening formed between the access door and the tray, and the first face of the access door at least partially covers the second face of the first tray when the device is in the closed configuration.

2. A device as recited in claim 1, wherein in the closed configuration, the access door substantially covers the first tray.

3. A device as recited in claim 1, wherein the access door includes decorative ornamentation.

4. A device as recited in claim 3, wherein the decorative ornamentation may be reconfigured by a user without removing the access door from the device.

5. A device as recited in claim 3, wherein the access door includes an innerportion and an outer portion and at least a portion of the decorative ornamentation is positioned between the inner portion and the outer portion.

6. A device as recited in claim 1, wherein the first tray includes an extension.

7. A device as recited in claim 6, wherein, when in the closed configuration, the extension is substantially covered by the access door.

8. A device as recited in claim 7, wherein the extension is selectively interposed between portions of the body and the access door.

9. A device as recited in claim 1, wherein, when in the closed configuration, the access door and the first tray define a substantially flush exterior surface.

10. The device as recited in claim 1, wherein the access door is configured to provide access to inner components of the device for changing ink.

11. The device of claim 1, wherein the access door is configured such that the first face covers a majority of the second face of the first tray when the device is in the closed configuration.

12. The device of claim 1, wherein the access door is configured such that the first face overlaps the second face when the device is in the closed configuration.

13. The device of claim 1, wherein the first face is configured to rest upon the second face when the device is in the closed configuration.

14. The device of claim 1, wherein the first face and the second face are configured to extend substantially parallel to one another when the device is in the closed configuration.

15. A tray-access door device, comprising:

a body including a first end and a second end;

an access door including a first face, a first edge and a means for connecting the access door at or about the first end;

a tray including a second face, a second edge and a means for connecting the tray at or about the second end, wherein the first tray includes a first portion pivotally coupled to the body and configured to extend along and overlap a side of the body and a second portion pivotally coupled to the first portion and configured to extend along and overlap a top of the body;

wherein, in an open configuration, the tray is extended from the body and an access opening is formed between the access door and the tray; and, in the closed configuration, the tray substantially covers the access opening and the first face of the access door overlaps at least a portion of the second face of the tray.

16. A device as recited in claim 15, wherein the device includes a means for interconnecting portions of the tray and access door in the closed position.

17. A method for reconfiguring a tray-access door device, comprising:

providing a tray-access door device, including a body having a first end and a second end; an access door having a first face and a first edge, and that is pivotally connected at or about the first end; and a tray having a second face and a second edge, wherein the first tray includes a first portion pivotally coupled to the body and configured to extend along and overlap a side of the body and a second portion pivotally coupled to the first portion and configured to extend along and overlap a top of the body wherein the first portion is pivotally connected at or about the second end, wherein when the access door is in a closed position and the tray is in an extended position, the access door and tray form an access opening therebetween;

positioning the access door to provide pivotal clearance for the tray;

pivoting the tray in a first direction to at least partially cover the access opening wherein the first portion extends along and overlaps a side of the body and wherein the second portion extends along and overlaps a top of the body; and pivoting the access door in a second opposite direction toward the body to at least partially overlap the second face of the tray with the first face of the door.

18. A method as recited in claim 17, wherein the access door includes decorative ornamentation.

19. A method as recited in claim 18, including the step of changing or reconfiguring the decorative ornamentation associated with the access door.

20. A method as recited in claim 18, wherein the decorative ornamentation includes a decorative media that is externally visible through the access door.

21. A method as recited in claim 20, including the step of changing the decorative media.

22. A method as recited in claim 18, wherein the decorative media is retained by the access door.

23. A method as recited in claim 17, including the step of interconnecting a portion of the access door and a portion of the tray.

24. A method as recited in claim 23, wherein the interconnection between the tray and the access door form a substantially flush external outer surface.

25. A tray-access door device comprising:

a body; and a tray including a first portion pivotally coupled to the body and a second portion pivotally coupled to the first portion, wherein the first portion and the second portion pivot between a first configuration in which the first portion and the second portion project from the body and a second configuration in which the first portion extends along and overlaps a side of the body and the second portion extends along and overlaps a top of the body.

26. The device of claim 25 including an access door, wherein the access door is configured to at least partially cover the second portion when the tray is in the second configuration.

27. A tray-access door device comprising:

a body having a component access opening;

a tray pivotally coupled to the body and including a first face and a first edge, wherein the first tray includes a first portion pivotally coupled to the body and configured to extend along and overlap a side of the body and a second portion pivotally coupled to the first portion and configured to extend along and overlap a top of the body; and an access door having a second face and a second edge and pivotally coupled to the body and covering the component access opening, the access door including a second face and a second edge, wherein the tray is at least partially received within the tray access opening and wherein the second face of the access door at least partially overlaps the first face of the tray when the device is in a closed configuration.

28. A tray-access door device, comprising:

a body including a first end and a second end;

an access door connected at or about the first end;

a first tray connected at or about the second end, wherein the first tray includes a first portion pivotally coupled to the body and configured to extend along and overlap a side of the body and a second portion pivotally coupled to the first portion and configured to extend along and overlap a top of the body;

wherein the first tray at least partially covers an access opening formed between the access door and the tray, and the access door at least partially covers the first tray when the device is in a closed configuration and wherein the access door is configured to provide access to inner components of the device for changing ink.

* * * * *

UNITED STATES PATENT AND TRADEMARK OFFICE

CERTIFICATE OF CORRECTION

PATENT NO. : 7,029,113 B2
APPLICATION NO. : 10/247887
DATED : April 18, 2006
INVENTOR(S) : Peter G Hwang It is certified that error appears in the above-identified patent and that said Letters Patent is hereby corrected as shown below:

In column 7, line 67, in Claim 5, delete “innerportion” and insert -- inner portion --, therefor.

Signed and Sealed this

Fourth Day of August, 2009

John Doll

JOHN DOLL
*Acting Director of the United States Patent and Trademark Office*